US011377716B2

(12) United States Patent
Kang et al.

(10) Patent No.: US 11,377,716 B2
(45) Date of Patent: Jul. 5, 2022

(54) CERMET HAVING IMPROVED TOUGHNESS AND METHOD FOR MANUFACTURING THE SAME

(71) Applicant: SEOUL NATIONAL UNIVERSITY R&DB FOUNDATION, Seoul (KR)

(72) Inventors: Shinhoo Kang, Incheon (KR); Heung Nam Han, Seoul (KR); Choongkwon Park, Seoul (KR); Nojun Kwak, Seoul (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 332 days.

(21) Appl. No.: 16/357,417

(22) Filed: Mar. 19, 2019

(65) Prior Publication Data

US 2020/0140977 A1 May 7, 2020

(30) Foreign Application Priority Data

Nov. 2, 2018 (KR) ..... 10-2018-0133279

(51) Int. Cl.

| | |
|---|---|
| ***C22C 29/10*** | (2006.01) |
| ***C22C 29/08*** | (2006.01) |
| ***C22C 29/00*** | (2006.01) |

(52) U.S. Cl.

CPC ..... *C22C 29/10* (2013.01); *C22C 29/005* (2013.01); *C22C 29/08* (2013.01)

(58) Field of Classification Search

None

See application file for complete search history.

(56) References Cited

U.S. PATENT DOCUMENTS 4,212,671 A * 7/1980 Ettmayer ..... C01B 21/0828 51/307

2010/0273637 A1 10/2010 Kang

FOREIGN PATENT DOCUMENTS

| | | |
|---|---|---|
| KR | 100796649 | 1/2008 |
| KR | 1020080077849 | 8/2008 |

OTHER PUBLICATIONS

Kim, Jiwoong, and Shinhoo Kang. "Microstructure evolution and mechanical properties of (Ti0. 93W0. 07) C—xWC—20Ni cermets." Materials Science and Engineering: A 528.7-8 (2011): 3090-3095. (Year: 2011).*

Kim, J. W., S. Y. Ahn, and S. Kang. "Effect of the complete solid-solution phase on the microstructure of Ti (CN)-based cermet." International Journal of Refractory Metals and Hard Materials 27.2 (2009): 224-228. (Year: 2009).*

* cited by examiner

*Primary Examiner* — Anthony M Liang

(74) *Attorney, Agent, or Firm* — Stuart H. Mayer; Mayer & Williams PC

(57) ABSTRACT

Provided is a cermet having improved toughness, the cermet including particles each of which has a complete solid-solution carbide of two or more metals selected, including titanium, from among Group IVa, Va, and VIa metals in the periodic table and has a core/rim structure composed of a core region and a rim region, and a binder composed of a metal, wherein the composition of the Group VIa metal in the core region is lower than the composition in the rim region, and the lattice constant in the rim region is larger than that in the core region.

4 Claims, 12 Drawing Sheets

Bright cores/dark rims

Bright cores/dark rims

Blurry cores/rims

Dark cores/bright rims $(Ti_{1-x}W_x)C$-30WC-5$Mo_2C$-3NbC-2TaC-20Ni

| | Core | Rim |
|---|---|---|
| W concentration (at.%) | 26.91 ± 0.75 | 30.74 ± 0.56 |
| Mo concentration (at.%) | 4.44 ± 0.24 | 5.56 ± 0.19 |
| Nb concentration (at.%) | 1.84 ± 0.11 | 1.98 ± 0.07 |
| Ta concentration (at.%) | 0.68 ± 0.06 | 0.56 ± 0.11 |

CERMET HAVING IMPROVED TOUGHNESS AND METHOD FOR MANUFACTURING THE SAME

CROSS-REFERENCE TO RELATED APPLICATION

This application claims priority to Korean Patent Application No. 10-2018-0133279 filed on Nov. 2, 2018, and all the benefits accruing therefrom under 35 U.S.C. § 119, the contents of which are incorporated by reference in their entirety.

BACKGROUND

The present disclosure relates to a cermet used in the cutting process, mining, etc., and having excellent toughness, and a method for manufacturing the same.

For cutting tools or wear-resistant tools mainly used in the cutting process, mining, etc., WC based hard alloys, various TiC or Ti(CN) based cermet alloys, other ceramics, or high-speed steels are used.

Among these, a cermet is generally a sintered body of ceramic-metal composite powder containing a hard phase, such as TiC or Ti(CN) and a binder metal, such as Ni, Co, or Fe, as main components, and, as an additive, carbide, nitride, or carbonitride of any of Group IVa, Va, and VIa metals in the periodic table. The cermet is prepared by mixing in addition to TiC or Ti(CN), a hard carbide additive such as WC, NbC, TaC or $Mo_2C$, and metal powder such as Co, Ni, and Fe, in a matrix phase, for binding the hard carbide additive, and sintering the mixture in a vacuum or in a nitrogen atmosphere. A TiC—$Mo_2C$—Ni cermet was first mass-produced by Ford Motor Company, USA, in 1956. Although this cermet was not greatly improved in toughness, it was used in semi-finishing and finishing as a high-hardness tool material for precise machining operations. In the 1960s and 1970s, in order to improve toughness, which is the great disadvantage of the TiC—Ni cermet system, attempts to add various elements to the above TiC—Ni cermet system were made, but did not attain outstanding results.

On the way, in the 1970s, Ti(C, N), which is a more stable thermodynamic phase, was realized through the addition of TiN to TiC, and toughness of Ti(C,N) was also improved to some degree. Because Ti(C,N) has a finer structure than TiC, toughness may be improved, and as well, chemical stability and mechanical impact resistance may be increased. Meanwhile, in the case where carbide is added to improve toughness, a general microstructure of a sintered TiC or Ti(CN) based cermet is observed as a core/rim structure, in which the hard phase of the core/rim structure is enclosed by a binder such as Ni, Co or Fe.

In the core/rim structure, the core region is undissolved TiC or Ti(CN) in the liquefied metal binder (Ni, Co) during sintering, the structure of which has high hardness. On the other hand, the rim region around the core region is a solid-solution phase (which is represented by (Ti, Me1, Me2 . . . ) (C,N)) between the core component, TiC or Ti(CN), and the additive carbide, and is a hard phase having higher toughness than the core. Because of good wettability with the metal binder (Ni, Co, Fe, etc.), the rim exhibits effects such as improved sinterability, improved toughness, etc. Thus, the toughness of the cermet was improved to some degree by solving low wettability problems, which are drawbacks of TiC—Ni or Ti(CN)—Ni based simple cermet, thanks to the formation of the rim structure.

However, the cermet having the core/rim structure still has a problem in that the toughness is 6-8 $MPa \cdot m^{1/2}$ which is inferior to WC—Co based hard alloys, and thus has not yet completely substituted for WC—Co. The reason has been found due to the fact that the cermet is easily broken under a mechanical impact environment because significantly high deformation energy is accumulated in an interface between the core and the rim of the core/rim structure.

Therefore, lots of effort to develop a cermet having improved toughness through the formation of a complete solid-solution phase without core/rim structure have been continuously made by tool manufacturers, such as Sumitomo, Mitsubishi, etc. In the case of cermets having a complete solid-solution phase without core/rim structure, toughness of 11-14 $MPa \cdot m^{1/2}$ comparable to the toughness values of WC—Co hard alloys can be obtained, but hardness is greatly reduced instead and thus a conspicuous success cannot be achieved.

SUMMARY

The present disclosure provides a cermet that can overcome low toughness of the conventional cermet having a core/rim structure and low hardness of the conventional cermet without core/rim structure and thus has toughness much higher than these conventional cermets. However, the object is only exemplary and thus the scope of the present invention is not limited by the object.

In accordance with an aspect of the present disclosure, there is provided a cermet having improved toughness, the cermet including: particles each of which has a complete solid-solution carbide of two or more metals selected, including titanium, from among Group IVa, Va, and VIa metals in the periodic table and has a core/rim structure composed of a core region and a rim region; and a binder composed of a metal.

In accordance with an embodiment, the composition of the Group VIa metal in the core region may be lower than the composition of the Group VIa metal in the rim region.

In accordance with an embodiment, the lattice constant in the rim region may be larger than that in the core region.

In accordance with an embodiment, the rim region may have a compressive stress state compared to the core region.

In accordance with an embodiment, the composition of the Group VIa element in an interface between the core region and the rim region may be gradually increased from the core region to the rim region.

In accordance with an embodiment, the difference in composition between the core region and the rim region may be 1 at % to 10 at %.

In accordance with an embodiment, the Group VIa element may include at least one from among W and Mo.

In accordance with an embodiment, the complete solid-solution phase of carbide of two or more metals may be a solid-solution of TiC and WC and may have a NaCl type face centered cubic structure.

In accordance with an embodiment, the binder may include at least one selected from the group consisting of Ni, Co, and Fe.

In accordance with another aspect of the present disclosure, embodiment, there is provided a method for manufacturing a cermet having improved toughness, the method including sintering mixed powder, wherein the mixed powder includes: first complete solid-solution carbide powder in which carbide of two or more metals selected, including titanium, from among Group IVa and VIa metals in the periodic table is completely solid-solutioned; an additive including carbide powder of at least one metal selected from among Group Va and VIa metals; and a binder including at least one metal powder.

In accordance with an embodiment, the sintering may include: a process in which the first complete solid-solution carbide powder is completely solid-solutioned in the binder; and a process in which second complete solid-solution carbide having a different composition from the first complete solid-solution carbide is precipitated from the binder.

In accordance with an embodiment, the process in which the second complete solid-solution carbide is precipitated may include: a process in which a core region is precipitated; and a process in which after the core region is precipitated, a rim region having a higher Group VIa metal composition than the core region is precipitated around the core region.

In accordance with an embodiment, the first complete solid-solution carbide powder may have an average particle size range of more than 0 and less than 60 nm.

In accordance with an embodiment, the first complete solid-solution carbide may be a solid-solution of TiC and WC and may have a NaCl type face centered cubic structure.

In accordance with an embodiment, the metal powder may include at least one from among Ni powder, Co powder, and Fe powder.

In accordance with an embodiment, the additive may include at least one from among WC, $Mo_2C$, TaC, NbC, and VC.

BRIEF DESCRIPTION OF THE DRAWINGS

Embodiments can be understood in more detail from the following description taken in conjunction with the accompanying drawings, in which.

DETAILED DESCRIPTION OF EMBODIMENTS

Figure 1:
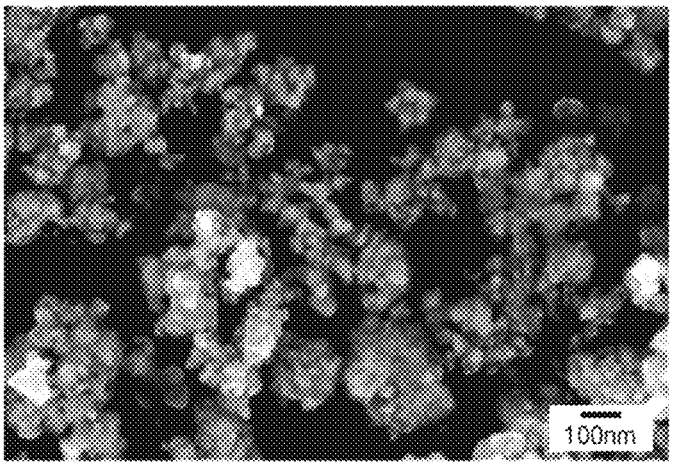
FIG. 1 shows a result obtained when $(Ti_{0.88}W_{0.12})C$ powder used in manufacturing of a cermet in accordance with an experimental example of the present disclosure was observed by a scanning electron microscopy (SEM)

Hereinafter, specific embodiments will be described in detail with reference to the accompanying drawings. However, the present invention is not limited to the embodiments disclosed below but may be implemented in various alternative forms. These embodiments are provided so that this disclosure will be complete, and will fully convey the scope of the invention to those skilled in the art. In addition, for convenience in description, in the accompanying figures, the sizes of elements may be exaggerated or reduced.

A cermet in accordance with an embodiment of the present disclosure includes complete solid-solution hard carbide particles and a metal binder for coupling the carbide particles.

The complete solid-solution metal carbide may form a complete solid-solution phase with at least one from among carbides of Group IVa metal essentially including titanium, and carbides of Group Va and VIa metals. For example, the carbide particle may be a carbide particle in which TiC and at least one from among carbides of Group Va and VIa metals form a complete solid-solution phase. The carbides of Group Va metals may include VC, TaC, and NbC, and the carbides of Group VIa metals may include WC, $Mo_2C$, and the like.

For example, the complete solid-solution carbide particle may exhibit a structure in which some of Ti atoms in the TiC lattice having the NaCl type face centered cubic (FCC) structure are substituted with other metal elements. Herein, the substituent metal element may be at least one from among Group IVa, Va and VIa metal elements. The solid-solutioned metal atoms are added to a solid solution limit of TiC. When the solid solution limit is exceeded, second carbide in addition to the complete solid-solution carbide is precipitated. For example, in a complete solid solution (Ti, W)C, when the W content exceeds the solid solution limit, WC may be precipitated as second carbide.

In accordance with an embodiment of the present disclosure, the complete solid-solution carbide particle is characterized by having a core/rim structure having a core region and a rim region. The core region and the rim region are composed of the same kind of atom and have the same crystal structure, but have a difference in composition of the same kind of element. The difference in composition allows the core region and the rim region to be discriminated. For example, when the carbide particle is a (Ti, W)C with a NaCl type FCC structure in which TiC and WC are completely solid solutioned, the W content in the core region may have a smaller value than the W content in the rim region, and thus the Ti content in the core region may have a larger value than the Ti content in the rim region. However, although the carbide particle has a core/rim structure, the composition change occurs gradually and continuously at the interface between the core region and the rim region. Accordingly, the interface between the core region and the rim region may be not conspicuous but be unclear. The difference in composition of Group VIa element, for example, W between the core region and the rim region may have values of 1 at % to 10 at %.

The complete solid-solution carbide particle has a local stress state difference because it has the same lattice structure but has a local composition difference. The metal carbide particle in accordance with an embodiment of the present disclosure exhibits that the lattice constant in the rim region has a large value than the lattice constant in the core region, and thus the rim region exhibits a compressive stress state due to the difference in lattice constant. For example, when the carbide particle is (Ti, W)C in which TiC and WC are completely solid-solutioned, the lattice constant of the TiC lattice changes as the atom is substituted with another atom having a difference in atomic radius from the atom. The substituent atom has a larger atomic radius than Ti, the lattice constant increases, and as the content of the substituent metal atom increases, the lattice constant will increase more greatly. For example, when the carbide particle is a (Ti, W)C in which TiC and WC are completely solid-solutioned, the atomic radius of W has a larger value than the atomic radius of Ti, and thus the rim region having a higher W content than the core region exhibits a greater lattice constant than the core region and also exhibits compressive stress.

Thanks to the core/rim structure having the core region and the rim region in which the composition change occurs gradually and the carbide particle having the rim region in the compressive stress state, the cermet in accordance with the present disclosure exhibits more remarkably excellent toughness characteristics than the conventional cermets.

In each of the conventional cermets, since the core/rim structure has a sharp composition change at the interface between the core region and the rim region, and considerably high deformation energy is accumulated at the interface between the core region and the rim region in such an interface structure, it is known that the conventional cermets are easily broken under an environment to which mechanical impact is applied.

In contrast, the cermet in accordance with an embodiment of the present disclosure has a composition change that is continuous and gradual at the interface between the core region and the rim region, and thus can solve a toughness reduction problem due to stress caused by an abrupt change in composition.

Meanwhile, it is known that Ti(CN) powder is used as the complete solid solution cermet having the core/rim structure. Compared with a conventional complete solid-solution cermet, the complete solid-solution cermet in accordance with the present disclosure is a complete solid-solution phase between different carbides and thus is different from the conventional complete solid-solution cermet. That is, the complete solid-solution cermet in accordance with the present disclosure does not contain N unlike the conventionally known complete solid-solution Ti(CN), and thus the content of a metal component having low affinity with N appears to be higher in the cermet in accordance with the present disclosure than that in the related art. Also, the complete solid-solution carbide of the complete solid-solution cermet in accordance with the present disclosure is a substitution type solid solution phase in which a metal atom is substituted with another metal atom, and shows a difference from the conventional Ti(CN) solid solution in that the lattice distortion in the solid solution is higher than in the conventional Ti(CN) solid solution.

The cermet having such a microstructure is manufactured by sintering mixture powder in which metal carbide powder and metal carbide additive powder are mixed with metal powder as a binder. As a method for manufacturing a sintered body, high temperature sintering, pressure sintering, or spark plasma sintering may be used, and a series of processes including mixing of powders, molding and sintering for manufacturing a cermet are well known arts in this technical field, and thus detailed description thereof will be omitted.

In the present disclosure, it is required to adjust the size of the complete solid-solution carbide particles used as a raw material to be smaller than the size of the conventional carbide particles. Hereinbelow, the reason will be described.

The dissolved amount of carbide can be expressed by Equation 1 below:

$$Q_i = S_{iW_i} m_{ti} \Delta t_i \quad \text{[Equation 1]}$$

$Q_i$: Average concentration of dissolved carbide i (mol/cm$^3$)

$S_i$: Average surface area of carbide i per mass (cm$^2$/g)

$W_i$: Concentration of carbide i particle (g/cm$^3$)

$m_{ti}$: Average dissolution rate of carbide I (mol·(cm$^2$·s)$^{-1}$)

$\Delta t_i$: Dissolution time (sec.)

The dissolved amount of carbide constituting a sintered body during sintering basically depends on thermodynamic stability of the carbide. In general, carbide having a solid solution phase, for example (Ti, W)C which is a solid solution phase of TiC and WC has thermodynamically higher stability than single phase carbides, for example TiC and WC that are not a solid solution phase, and thus has a slower dissolution rate. Accordingly, when referring to Equation 1, in order to increase the dissolved amount ($Q_i$) of the solid solution phase carbide, the surface area of power used should be as small as possible. That is, in Equation 1, $_{Wi}$, $m_{ti}$, and $\Delta t_i$ are values fixed when the sintering condition and the composition are determined. Accordingly, by adjusting the value of $S_i$, the value of $Q_i$ can be increased during the same time period.

Because of the above-described reason, when the raw material carbide used for manufacturing a sintered body is solid solution phase carbide, a sintered body can be manufactured more rapidly and uniformly by making the raw material carbide smaller in size than normal carbide that is not a solid solution phase to increase the surface area of the raw material carbide. In accordance with embodiments of the present disclosure, the average particle size of carbide having a solid solution phase is in a range of more than zero and no more than 60 nm, preferably in a range of 5 nm to 50 nm, more preferably in a range of 10 nm to 40 nm.

The metal carbide additive includes carbide powder of at least one metal selected from among Group Va and VIa metals including W. The metal carbide additive may include, for example, WC, $Mo_2C$, TaC, NbC, VC, etc. The metal carbide additive may serve as a supplier supplying, to the inside of the complete solid solution phase carbide powder particles, the same metal as at least one of the metal components included in the complete solid solution phase carbide while being mixed with the complete solid solution phase carbide powder and sintered. Due to the addition of such metal carbide, a mechanical property, for example hardness or toughness of the cermet can be enhanced. The metal carbide additive may have a size ranged from 2-4 μm.

The binder is composed of at least one kind of metal functioning to bind carbide particles undissolved during sintering. The binder may be selected from among metals such as Ni, Fe, and Co.

Hereinafter, in order to help understanding of the present disclosure, experimental examples to which the above-described technical spirit is applied will be described. However, it should be understood that the following experimental examples are only provide to help understanding of the present disclosure and the present disclosure is not limited by the following experimental examples.

[Experimental Examples]

Table 1 below shows kinds and compositions of powders used as raw materials for manufacturing cermets, wherein the compositions are expressed in the unit of % by weight (wt %).

TABLE 1

| Experimental example | $(Ti_{0.88}W_{0.12})C$ | WC | $Mo_2C$ | NbC | TaC | Ni | Co |
|---|---|---|---|---|---|---|---|
| 1 | 70 | 10 | 0 | 0 | 0 | 20 | 0 |
| 2 | 60 | 20 | 0 | 0 | 0 | 20 | 0 |
| 3 | 50 | 30 | 0 | 0 | 0 | 20 | 0 |
| 4 | 40 | 40 | 0 | 0 | 0 | 20 | 0 |
| 5 | 40 | 40 | 0 | 0 | 0 | 10 | 10 |
| 6 | 55 | 30 | 0 | 0 | 0 | 15 | 0 |
| 7 | 40 | 30 | 5 | 3 | 2 | 20 | 0 |

Figure 2:
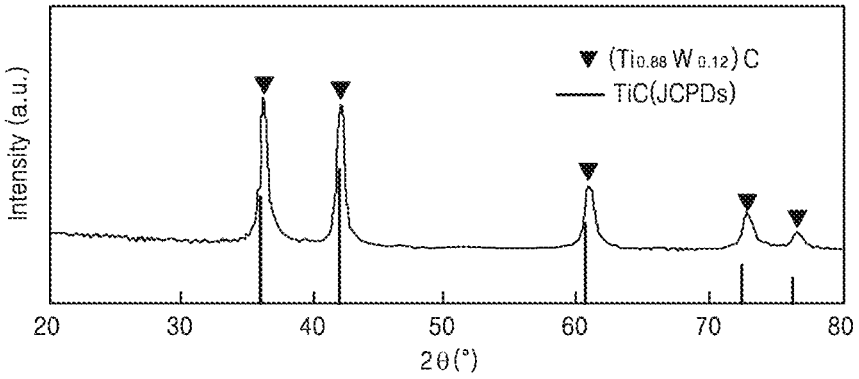
FIG. 2 shows an X-ray diffraction analysis result of the $(Ti_{0.88}W_{0.12})C$ powder.

$(Ti_{0.88}W_{0.12})C$ powder that is complete solid solution phase powder used in Experimental examples was manufactured by weighing $TiO_2$, $WO_3$, C (graphite) according to mole fractions thereof, performing high energy milling, and performing carbonization and reduction at 1,150° C. for 4 hours. FIG. 1 shows a result obtained when the manufactured $(Ti_{0.88}W_{0.12})C$ powder was observed by a scanning electron microscopy (SEM), FIG. 2 shows an X-ray diffraction analysis result of the $(Ti_{0.88}W_{0.12})C$ powder. The BET result from which the particle size and the specific surface area can be known are shown in Table 2.

TABLE 2

| Powder | Particle size (μm) | BET surface area ($m^2/g$) |
|---|---|---|
| $(Ti_{0.88}W_{0.12})C$ | $0.03^a/0.029^b$ | 35.685 |
| WC | 2.73 | — |
| Ni | 2.40 | — |

[a]Particle size by BET measurement

[b]Crystallite size calculated by the Rietveld refinement method

Referring to FIG. 1 and Table 2, the $(Ti_{0.88}W_{0.12})C$ powder is approximately spherical powder and exhibits a particle size of about 30 nm, and BET value of about 35.6 $m^2/g$. In Table 2, the particle sizes of WC powder and Ni powder used in the experimental example are also exhibited.

Referring to the X-ray diffraction analysis result of FIG. 2, it can be known that $(Ti_{0.88}W_{0.12})C$ powder is composed of a single phase exhibiting a TiC crystal structure that is the NaCl type face centered cubic (FCC) structure. That is, it is interpreted that the $(Ti_{0.88}W_{0.12})C$ powder has the TiC crystal lattice structure in which Ti atom in the TiC lattice is substituted with W and the substituent W is solid-solutioned. From this fact, it can be confirmed that the $(Ti_{0.88}W_{0.12})C$ powder has a single phase in which TiC and WC are completely solid-solutioned.

The powders shown in Table 1 were mixed using a ball-mill and were uniaxially pressed at a pressure of 150 MPa within a cylindrical die to make a molded body, and the molded body was loaded into a vacuum furnace and then sintered at 1,510° C. for 1 hour to manufacture a cermet.

Figure 3:
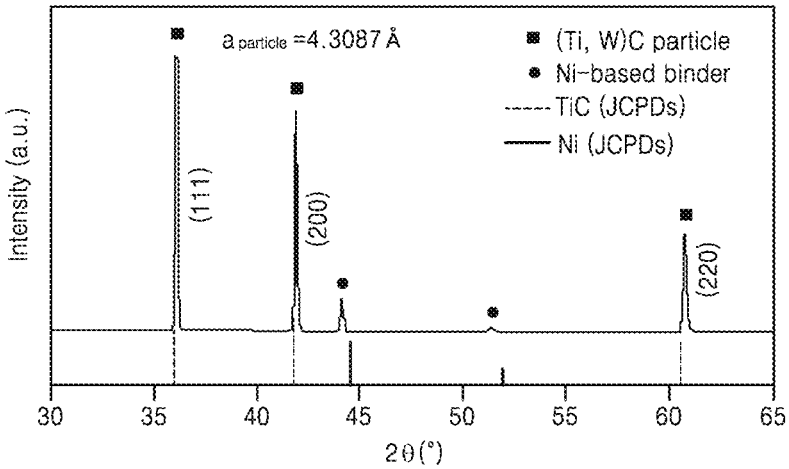
FIG. 3 shows an X-ray diffraction analysis result of a cermet in accordance with an experimental example of the present disclosure.

FIG. 3 shows an X-ray diffraction analysis result of a sintered body corresponding to Experimental example 4 after the sintering was completed.

Referring to the X-ray diffraction analysis result of FIG. 3, it can be confirmed that only a (Ti,W)C diffraction peak that is a complete solid solution phase of TiC and WC and a diffraction peak corresponding to the nickel binder are found. From this confirmation, it can be seen that the core/rim structure carbide constituting the sintered body is a complete solid solution phase of a single phase. In addition, the lattice constant obtained from the Bragg's Law using the (220) peak among the X-ray diffraction peaks was 4.3087 Å, which is similar to the value obtained from the electron diffraction of the transmission electron spectroscopy to be described below.

Figure 4A:
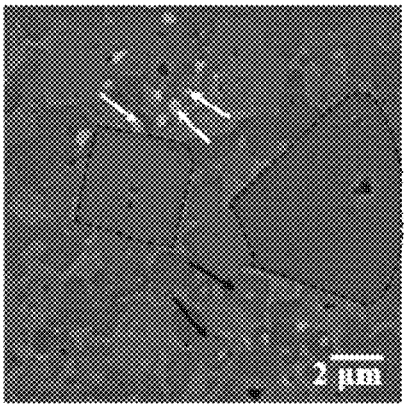
FIGS. 4A, 4B, 4C, and 4D show results obtained when the microstructures of cermets in accordance with Experimental examples of the present disclosure were observed by a scanning electron microscopy (SEM)
Figure 4B:
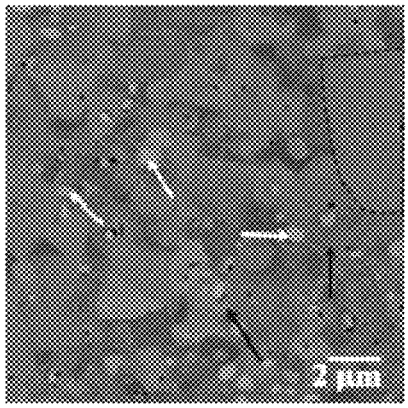

FIGS. 4A to 4D show results obtained when the microstructures of cermets of Experimental examples 1 to 4 were observed by an FESEM-BSE. Referring to FIGS. 4A to 4D, the cermets in accordance with the Experimental examples 1 to 4 each are composed of (Ti, W)C particles and a binder for binding the (Ti, W)C particles. Referring to FIG. 4A, in the case of Experimental example 1 in which the added WC content was 10 wt %, a dark rim region and a bright core region were markedly observed, and in the case of Experimental example 2 in which the added WC content was 20 wt %, a similar result was obtained. The observation of the FESEM-BSE may provide brightness contrast due to a back scattering electron signal sensitive to the atomic number. The bright region in the photograph observed by the FESEM-BSE corresponds to a region where elements that have a high atomic number and are heavy are concentrated. From these observation results of Experimental examples 1 and 2, it can be analogized that the relatively bright core region (white arrow) has a more addition content of W than the dark rim region (black arrow). In addition, as shown in FIGS. 4A and 4B, the cermet particles have facet shapes and abnormal particles having a remarkably large particle size compared with the average particle size were sometimes observed.

Figure 4C:
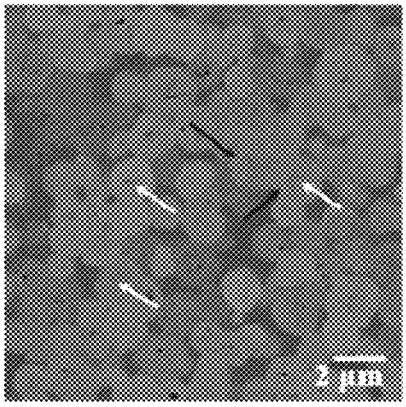
Figure 4D:
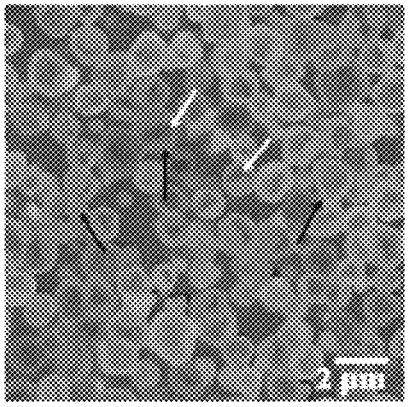

In the cases of Experimental examples 3 and 4 in which the added WC contents were 30 wt % and 40 wt %, a distinct difference between microstructures was observed compared with the Experimental examples 1 and 2 in which the added WC contents were not more than 20 wt %. Referring to FIGS. 4C and 4D, it can be confirmed that an abnormal particle having an abnormally large particle size is not observed any more, and the particles have relatively rounded shapes. This result indicates that the surface anisotropy of the (Ti, W)C solid solution particle decreases as the WC content increases.

In addition, in the case of Experimental example 3 in which the WC content was 30 wt %, a brightness difference between the core region and the rim region is not distinct and thus the interface between the core region and the rim region appears unclear. Further, in the case of Experimental example 4 in which the WC content was 40%, brightness conversion in which the core region is rather darker than the rim region occurs. This result indicates that the W contents in the core region and the rim region in the case of Experimental example 3 are similar and the W content in the rim region in the case of Experimental example 4 is rather higher than the W content in the core region.

In the cermets in accordance with the Experimental examples of the present disclosure, it is interpreted that the cored structure forms a core/rim structure through complete solid solution and uniform precipitation of $(Ti_{0.88}W_{0.12})C$ nano particles, and it is determined that the cermets in accordance with the Experimental examples of the present disclosure have a different core/rim structure from the conventional core/rim structure according to the generation mechanism of such a core/rim structure.

The core region of the conventional Ti(CN)-based cermet corresponds to a Ti(CN) particle which has been partially solid solutioned. Thus, the conventional Ti(CN)-based cermet showed a sharp difference in content of a constituent element based on the core/rim interface, and the sharp difference caused a large lattice deformation at the core/rim interface. The large lattice deformation caused high stress to be generated at the core/rim interface.

However, in the cases of Experimental examples of the present disclosure, since the core/rim structure is formed while $(Ti_{0.88}W_{0.12})C$ nano particles are uniformly precipitated after being completely solid solutioned in the metal binder during the sintering, a sharp difference in element content at the core/rim interface is not shown unlike the conventional case. This result indicates that the stress at the core/rim interface is considerably released compared with the conventional core/rim structure.

FIGS. 5A to 5D show results obtained when local compositions of phases existing in cermets corresponding to Experimental examples 1 to 4 were analyzed using a scanning transmission electron microscope-energy dispersive spectroscopy (STEM-EDS), and which are High-angle annular dark-field (HAADF) results showing local spots analyzed through STEM-EDS. The HAADF analysis results provide the z-contrast signal particularly sensitive to an element having a high atomic number, and thus the bright region corresponds to a region where heavy metal elements are concentrated. Referring to FIGS. 5A to 5D, it can be confirmed that the brightness results in the core region and the rim region have the same tendency as the results shown in FIG. 4.

Figure 5A:
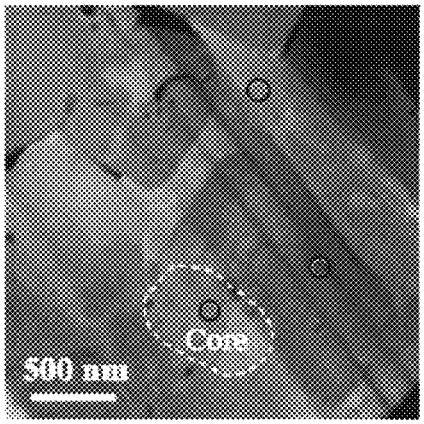
FIGS. 5A, 5B, 5C, and 5D show results obtained when the microstructures of cermets in accordance with Experimental examples of the present disclosure were observed by a transmission electron microscopy (TEM)
Figure 5B:
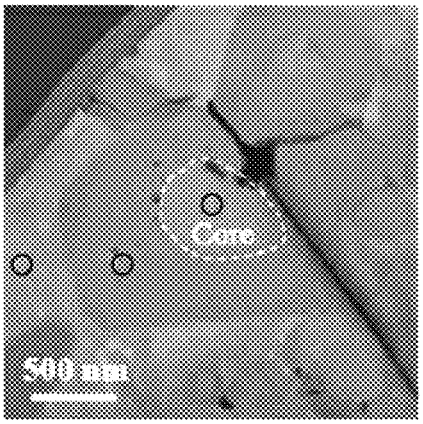
Figure 5C:
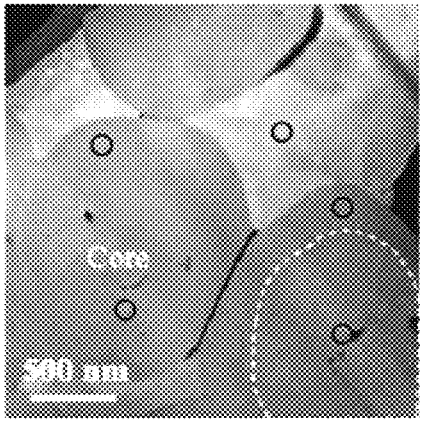
Figure 5D:
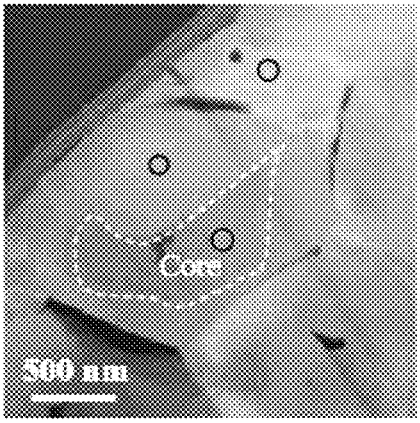
Figure 6A:
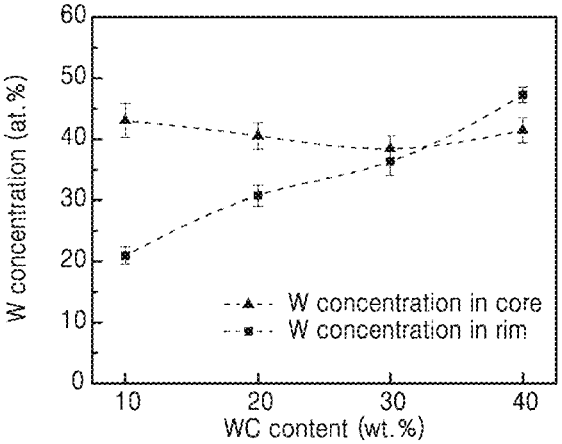
FIGS. 6A and 6B show analysis results of the W content in the core regions and the rim regions of cermets in accordance with Experimental examples of the present disclosure.
Figure 6B:
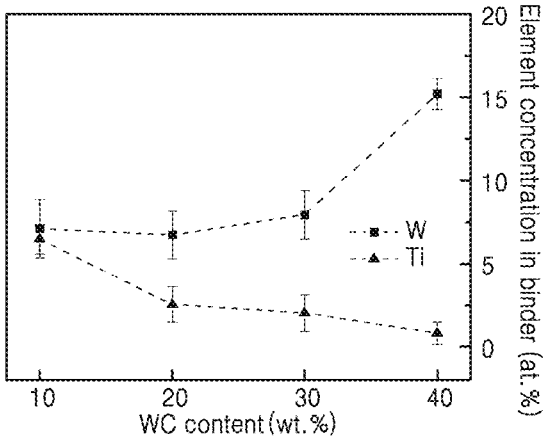

The portions indicated by the circles in FIGS. 5A to 5D are regions where the local composition was analyzed, and the analysis results are shown in FIGS. 6A and 6B. FIG. 6A shows the W content (at %) in the core region and the rim region, and FIG. 6B shows the W content and the Ti content in the Ni binder.

Referring to FIG. 6A, it can be confirmed that the concentration of W in the core region is approximately constant regardless of the added W content, whereas the concentration of W in the rim region is greatly affected by the added W content. In addition, in the cermets of Experimental examples 1 to 4, the W content of the core region is about 40 at %, which is a completely different value from the W content in the $(Ti_{0.88}W_{0.12})C$ powder introduced as a raw material in the process of manufacturing the cermet, and is a remarkably high value. For discrimination between these powders, the (Ti, W)C powder used as a raw material for manufacturing a cermet may be referred to as first complete solid solution carbide, and the (Ti, W)C complete solid solution particle precipitated in the sintering process for manufacturing a cermet may be referred to as second complete solid solution carbide.

The reason why the composition distributions of W are different in the core region and the rim region is because the $(Ti_{0.88}W_{0.12})C$ powder is completely solid solutioned in the binder during the sintering and then is again precipitated to form the core/rim structure of the cermet. The core region is formed by precipitation at a specific temperature during the sintering, and thus shows the composition close to the thermodynamic equilibrium, for example the composition of 30-50 at %. Meanwhile, since the rim region is formed around the core region after the core region has been formed, when a sufficient amount of W exists in the N binder, the W content in the rim region can be allowed to the solid solution limit.

Referring to FIG. 6B, the higher the added WC content, the higher the W content in the binder was, and thus the Ti content was relatively reduced. Similarly to the W content in the Ni binder, the W content in the rim region showed a similar result according to the WC content. Specifically, referring to FIG. 6A, when the added WC contents were 10 at % and 20 at %, the concentration of W in the rim region was much lower than that in the core region, and when the WC content was 30 at %, the concentration of W in the rim region was almost similar to that in the core region. When the WC content was 40 at %, conversion in the W content in the core region and the rim region occurred, and thus the W content in the rim region was higher than that in the core region. This composition analysis result corresponds to the FESEM-BSE and HAADF analysis results shown in FIGS. 4 and 5.

Referring to FIG. 5D, it can be confirmed that the core region portion relatively dark is formed at a center of the carbide particle and the rim region relatively bright is formed around the core region. From the analysis results of W contents in the core region and the rim region, it could be seen that the W content in the core region was 41.4 at % and the W content in the rim region was 47.2 at % and thus the W content in the rim region was much higher than that in the core region. Correspondingly, the Ti content in the core region was higher than that in the rim region.

Figure 7:
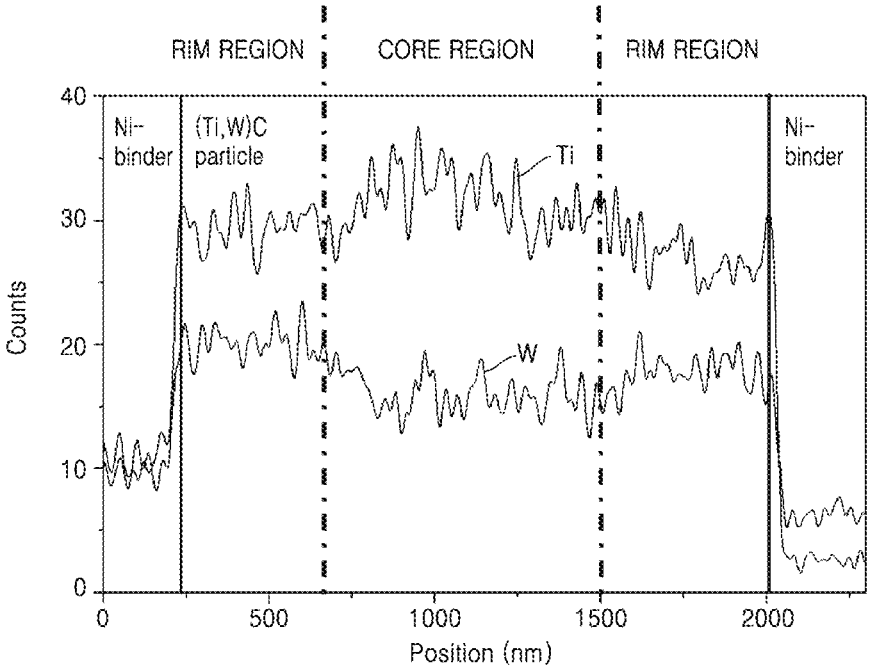
FIG. 7 shows a line scanning result for analyzing the composition distribution of carbide particles of a cermet in accordance with an experimental example of the present disclosure.

In order to confirm the composition distributions according to regions in a carbide particle, a line scanning for the carbide particle corresponding to Experimental example 4 was carried out from the rim region to the core region of the carbide particle and again to the rim region, and the line scanning result is shown in FIG. 7.

Referring to FIG. 7, as it goes from the rim region to the core region, the W content decreases continuously, and the W content in the core region is maintained at a lower value than that in the rim region. Then, as it again returns to the rim region, it can be confirmed that the W content at the interface between the core region and the rim region increases continuously. Correspondingly, the Ti content shows a continuous increase and decrease state that is opposite to the change in the W content.

Referring to FIG. 7, it can be seen that the W content in the core region of the sintered body of Experimental example 1 has a lower value than that in the rim region. Particularly, it can be seen that the W content at the interface between the core region and the rim region is not sharply changed in a stepwise manner, but the composition change occurs continuously and gradually. It is determined that the interface between the core region and the rim region appears unclear due to such an interface structure when the carbide particle is observed. This interface structure contributes to enhancement in toughness of the cermet, which will be described below.

Figures 8A, 8B, 8C:
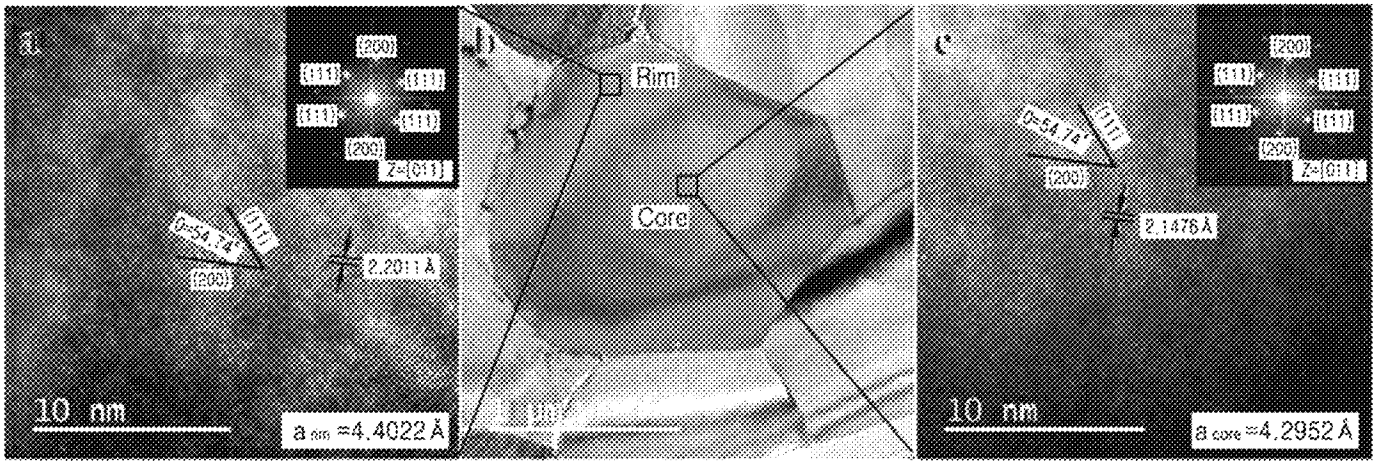
FIGS. 8A. 8B and 8C show results obtained when the carbide particles of cermets in accordance with Experimental examples of the present disclosure were observed by a transmission electron microscopy (TEM)

FIGS. 8A to 8C show a result obtained when carbide in a sintered body corresponding to Experimental example 4 was observed by a transmission electron microscopy (TEM) and an electron diffraction analysis was performed with respect to the core region and the rim region. FIG. 8A shows an electron diffraction analysis result of the rim region, and FIG. 8C shows an electron diffraction analysis result of the core region.

Referring to FIGS. 8A and 8C, it can be seen that both of the core region and the rim region have the same NaCl type face centered cubic (FCC) crystal structure, which corresponds to the X-ray diffraction analysis result of FIG. 3. However, the lattice constant in the core region was 4.2952 Å, whereas the lattice constant in the rim region was 4.40022 Å which is a larger value than that in the core region. That is, the average lattice constant of the carbides is about 4.34 Å, and almost corresponds to the result (FIG. 3) obtained from the XRD peak analysis, but the carbide has a local difference in lattice constant therein.

The difference in lattice constant within the carbide particle is due to a difference in composition. As described above, the carbide particle is a complete solid solution phase of TiC and WC, and has a crystal structure in which Ti atom site in the TiC crystal structure is substituted with W. Since the atomic radius of W is larger than that of Ti, an increase of the substituent W content increases the lattice constant. As described above, the W content in the rim region is higher than that in the core region, and thus the lattice constant in the rim region is higher than that in the core region due to the difference in the W content.

Due to the difference in lattice constant between the core region and the rim region within the carbide particle, the rim region becomes a compressive stress state. That is, within a single phase carbide having lattice constants different from each other, the region having a greater lattice constant is subjected to compressive stress, and conversely, the region having a smaller lattice constant is subjected to tensile stress. In the core/rim structure of the carbide, as the rim region has a compressive stress state, the effect in which toughness of the sintered body is enhanced can be exhibited.

In the cermet in accordance with the present experimental example, the carbide particle that is a hard phase forms a complete solid solution single phase, but has the cored structure of core/rim due to the difference in composition therein. However, the carbide structure in which the composition changes gradually and continuously at the interface between the core region and the rim region and the rim region is subjected to compressive stress, acts as an important factor for toughness enhancement.

Figure 9:
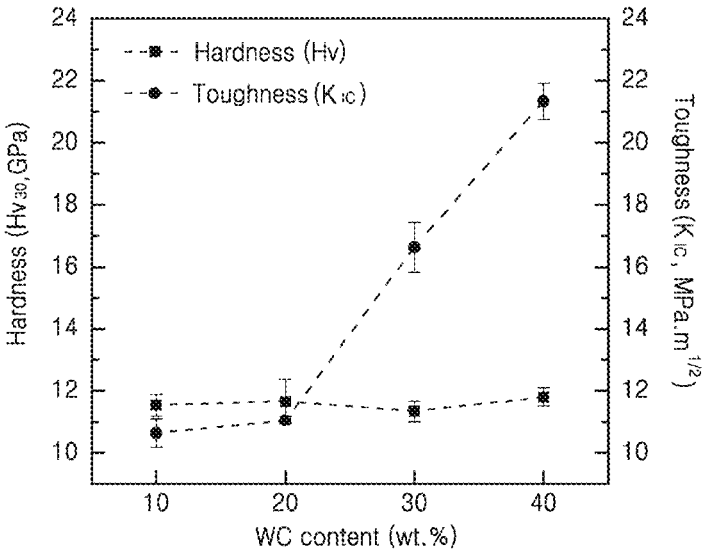
FIG. 9 shows analysis results of Vickers hardness and fracture toughness of cermets in accordance with Experimental examples of the present disclosure.

FIG. 9 shows measurement results of Vickers hardness and fracture toughness of cermets according to the WC contents. The Vickers hardness was obtained by taking an average value through five times indentations under load of 30 kg for loading time of 15 seconds, and the toughness was obtained by using the lengths of cracks after the measurement of the Vickers hardness.

Referring to FIG. 9, the Vickers hardness was maintained as almost a constant value regardless of a change in the added amount of WC. In contrast, when the added amount of WC was 30 wt % or more, a result in which the toughness was sharply increased was exhibited. Particularly, when the added amount of WC was 40 wt %, the toughness was 22 $MPam^{1/2}$ which is a very high value compared with the conventional case.

In the case where the added amount of WC was 30 wt %, as shown in FIG. 6A, the W contents in the core region and the rim region were similar, and it was determined from the result that the toughness was enhanced due to the miniaturization of lattice deformation. Meanwhile, the toughness in the case where the added amount of WC was 40% was superior to that in the case where the added amount of WC was 30 wt %, which was determined to be due to the compressive stress in the rim region.

FIGS. 10A to 10D show crack forms caused by indentations in cermets corresponding to Experimental examples 1 to 4.

TABLE 3

| Experimental example | Trans-granular fracture percentage | Inter-granular fracture percentage |
|---|---|---|
| Experimental example 1 | 79.1 ± 3.2 | 20.9 ± 3.2 |
| Experimental example 2 | 61.6 ± 3.1 | 38.4 ± 8.4 |
| Experimental example 3 | 24.6 ± 5.1 | 75.4 ± 8.4 |
| Experimental example 4 | 10.6 ± 0.7 | 89.4 ± 7.8 |

Figure 10A:
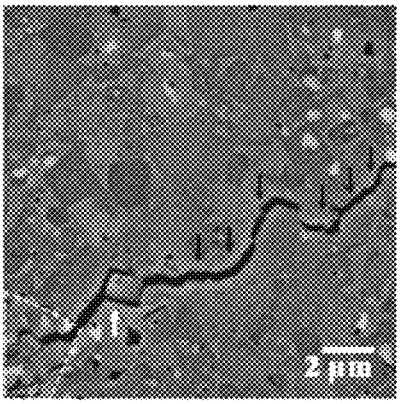
FIGS. 10A, 10B, 10C and 10D show observation results of fracture forms in cermets in accordance with Experimental examples of the present disclosure.
Figure 10B:
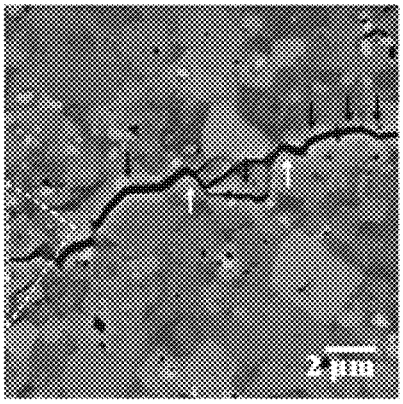
Figure 10C:
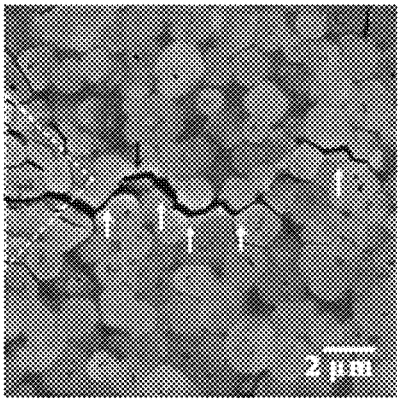
Figure 10D:
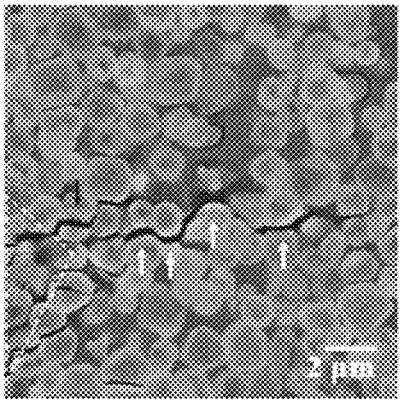

Referring to FIGS. 10A to 10D, the manufactured cermets exhibit an inter-granular fracture (white arrows in FIGS. 10A to 10D) generated along a interface between the carbide and the binder, and a trans-granular fracture (black arrows in FIGS. 10A to 10D) which passes through the inside of the carbide particle according to the added WC content. The percentages of fractures according to the respective experimental examples are shown in Table 3. As shown in FIGS. 10A and 10B, when the added WC content was 20% or less, the trans-granular fracture was mainly generated, and as shown in FIGS. 10C and 10D, when the added WC content was 30 wt % or more, the inter-granular fracture was mainly generated. Particularly, in the case of Experimental example in which the added WC content was 40%, the percentage of the inter-granular fracture was almost 90%.

The trans-granular fracture shown in FIGS. 10A and 10B exhibits a smooth shape in which the trans-granular fracture was linearly generated along a cleavage plane of a brittle material, whereas the inter-granular fracture shown in FIG. 10C and 10D exhibits a very coarse shape which is typically observed in soft materials.

The percentage of the inter-granular fracture increases with the increase of the added WC content, which may be associated with an increase of fracture energy. It is determined that this result is obtained because the increase of the added WC content decreases lattice deformation energy due to a concentration difference in the interface between the core region and the rim region.

Meanwhile, the difference in the W content of the interface between the core region and the rim region exhibits a higher value in the case of Experimental example 4 where the added WC content was 40 wt % than in the case of Experimental example 3 where the added WC content was 30%, but the percentage of the inter-granular fracture exhibits a higher value in Experimental example 4 than in Experimental example 3. These results indicate that the increase in the WC content may increase trans-granular fracture energy along a cleavage plane of the carbide particle.

The size and shape of the carbide particle may also affect the generation and growth of fracture. As the size of the carbide particle increases, the fracture propagation is difficult to be deflected, and as the carbide particle becomes close to the circular shape, the possibility of the fracture propagation further increases. Accordingly, as shown in FIGS. 10C and 10D, in the case of Experimental examples 3 and 4 in which the size of the carbide particle is relatively small and the carbide particle has the rounded shape, the generation probability of the inter-granular fracture increases.

The detailed compositions of cermets which were manufactured by adding Co as a binder in addition to Ni or further adding $Mo_2C$, NbC, or TaC as carbide in addition to WC are shown in Experimental example 5 to 7 of Table 1.

Figures 11A, 11B, 11C:
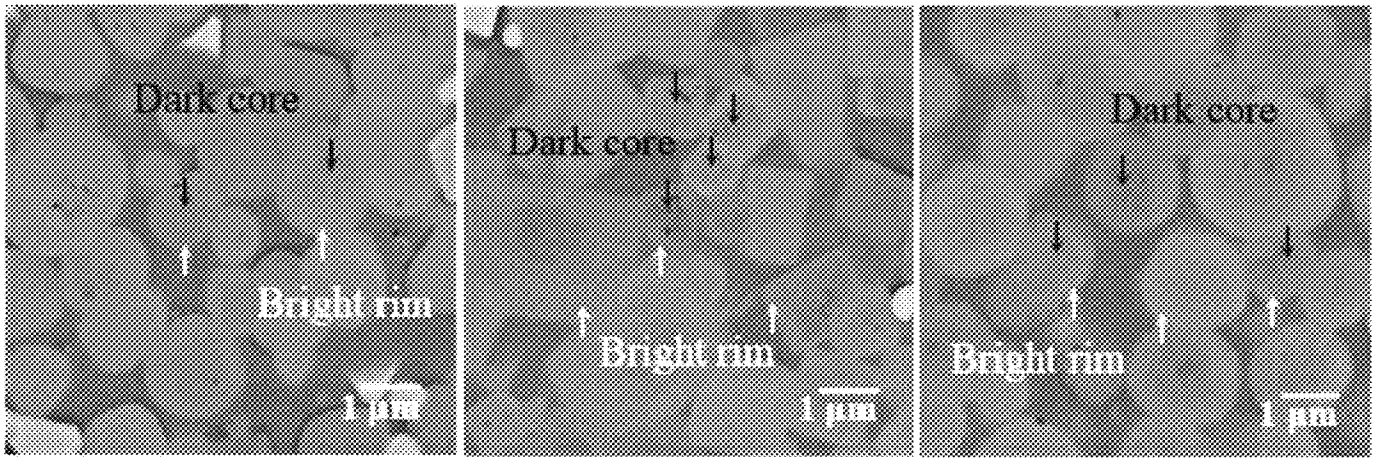
FIGS. 11A, 11B, 11C and FIG. 12 show results obtained when the carbide particles of cermets in accordance with Experimental examples of the present disclosure were observed by a SEM.

FIGS. 11A to 11C show results obtained when fine structures of cermets manufactured from the powders respectively corresponding to Experimental examples 5 to 7 were observed using a scanning electron microscopy. Referring to FIGS. 11A to 11C, it can be confirmed that the cermets in accordance with Experimental example 5 to 7 each have a core/rim structure having a core region which is formed at the center of the carbide particle and is a relatively dark portion, and a rim region which is formed around the core region and is a relatively bright portion.

Figure 12:
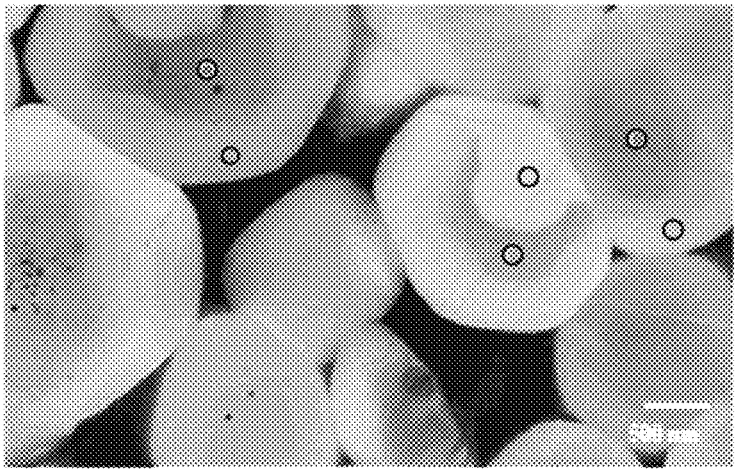

FIG. 12 shows results obtained when carbide particles constituting a cermet of Experimental example 7 were observed by a SEM and components of a specific portion were analyzed. Referring to FIG. 12, it could be confirmed that in the cermet ((Ti,W)C-30WC-5$Mo_2$C-3NbC-2TaC-20Ni) of Experimental example 7, the rim region which is a relatively bright region was formed around the core region. In addition, like in Experimental example 4, it was exhibited that the W content in the core region was lower than that in the rim region and the content of Mo that is a Group VIa element like W was also higher in the rim region than in the core region.

Figure 13:
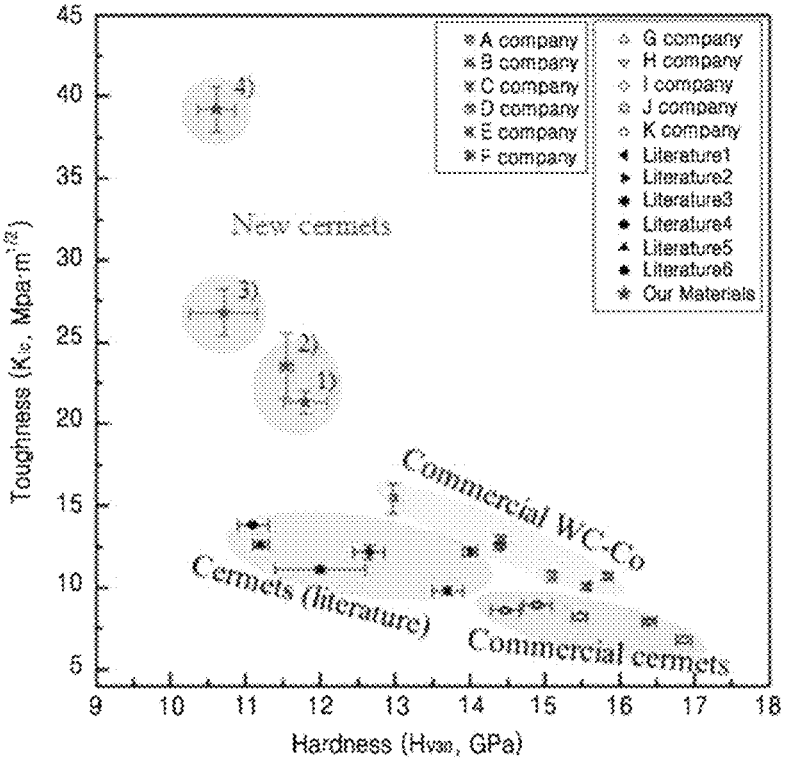
FIG. 13 shows results of Vickers hardness (Hv30) and toughness of cermets in accordance with Experimental examples of the present disclosure together with the results of commercial WC—Co hard materials, commercial cermets, and cermets reported in literatures.

FIG. 13 shows results of Vickers hardness (Hv30) and toughness of specimens corresponding to Experimental examples 4 to 7 together with the results of commercial WC—Co hard materials, commercial cermets, and cermets reported in literatures. The values expressed by 1), 2), 3) and 4) in the upper left side are values corresponding to Experimental examples 4, 5, 6, and 7. Referring to FIG. 9, the cermets in accordance with the Experimental examples of the present disclosure exhibit remarkably superior toughness compared with the conventional commercial cermets or commercial WC—Co hard materials. It can be confirmed that the cermets in accordance with the Experimental examples of the present disclosure exhibit hardness values which are similar to somewhat smaller than the cermets reported in the literatures, but have remarkably superior toughness. Accordingly, unlike the conventional cermets which have been used in limited application fields, it is expected that the application of the cermets in accordance with the present disclosure can be expanded to a wider range. Thus, the cermets employing the manufacturing method of the present disclosure can solve the low toughness problem of the conventional cermets and hard materials (according to the adjustment of hardness and toughness obtained by adjusting the contents of the binder and the added carbide, hardness of 0-15 GPa and toughness of 15-40 $MPa \cdot m^{1/2}$ can be secured).

It is expected that the cermets in accordance with the present disclosure have remarkably enhanced toughness unlike typical cermets and are applicable to a variety of extreme environment fields (defense, aviation, space, ocean, nuclear fusion power generation, and etc.), bearings and the like which require high toughness. Specific examples are high temperature structure materials, armored cars such as tanks, empty cartridges of kinetic energy penetrators, extreme environment materials inside nuclear fusion reactor. In addition, it is expected that when a ceramic coating ($Al_2O_3$, TiN, TiAlN, and etc.) generally performed for tool materials is applied to the cermets manufactured in the present disclosure to compensate for the insufficient hardness, the cermets can be utilized for cutting tools having longer lifespan than the existing cutting tools.

As described above, a cermet in accordance with an embodiment of the present disclosure has a fine structure differentiated from conventional cermets, and thus has very superior toughness, thereby achieving remarkable effects of improving the mechanical characteristics of products. Of course, the scope of the present invention is not limited by these effects.

Although the present disclosure has been described with reference to the specific embodiments, it will be readily understood by those skilled in the art that the embodiments are only exemplary and various modifications and changes can be made thereto without departing from the spirit and scope of the present invention defined by the appended claims. Accordingly, the true technical protection scope of the present disclosure should be determined by the technical idea of the appended claims.

What is claimed is:

1. A cermet comprising:

particles, each of which has a complete solid solution of TiC and WC which is made from $TiO_2$, $WO_3$, and graphite, and has a core/rim structure composed of a core region and a rim region, and has a face centered cubic structure; and a binder composed of a metal, wherein an amount of W in the core region is lower than an amount of W in the rim region, wherein an amount of W in an interface between the core region and the rim region is gradually increased from the core region to the rim region, and wherein a lattice constant in the rim region is larger than that in the core region.

2. The cermet of claim 1, wherein the rim region exhibits a compressive stress state.

3. The cermet of claim 1, wherein a difference in the amounts of W between the core region and the rim region is 1 at % to 10 at %.

4. The cermet of claim 1, wherein the binder comprises at least one selected from the group consisting of Ni, Co, and Fe.

* * * * *